United States Patent [19]

Lister

[11] Patent Number: 4,765,887

[45] Date of Patent: Aug. 23, 1988

[54] SYSTEM FOR JOINING SECTIONS OF A HYDROCYCLONE SEPARATOR

[75] Inventor: Roy D. Lister, Keller, Tex.

[73] Assignee: Eagle-Picher Industries, Inc., Cincinnati, Ohio

[21] Appl. No.: 19,422

[22] Filed: Feb. 26, 1987

[51] Int. Cl.[4] ..... B04C 5/85

[52] U.S. Cl. ..... 209/211; 277/101; 277/128; 277/167

[58] Field of Search ..... 209/211; 277/101, 128, 277/164, 167, 168, 178, 179, 207 R, 214

[56] References Cited

U.S. PATENT DOCUMENTS

| | | | |
|---|---|---|---|
| 2,766,054 | 10/1956 | Everhart | 277/167 |
| 3,099,060 | 7/1963 | Smith | 277/101 |
| 3,288,300 | 11/1966 | Bouchillon | 210/84 |
| 3,419,290 | 12/1968 | Campbell et al. | 277/101 |
| 3,572,774 | 3/1971 | Sipler | 277/101 |
| 4,053,167 | 10/1977 | Jelinek | 277/167 |
| 4,067,814 | 1/1978 | Surakka et al. | 210/512 R |
| 4,140,632 | 2/1979 | Boivin | 210/84 |
| 4,237,006 | 12/1980 | Colman et al. | 210/84 |
| 4,251,368 | 2/1981 | Colman et al. | 210/788 |
| 4,309,283 | 1/1982 | Vikio et al. | 209/211 |
| 4,337,068 | 6/1982 | MacLean et al. | 55/1 |
| 4,344,783 | 8/1982 | Heinemann et al. | 55/459 B |
| 4,358,369 | 11/1982 | Matula et al. | 209/211 |
| 4,586,720 | 5/1986 | Simmons et al. | 277/164 |

*Primary Examiner*—Joseph F. Peters, Jr.
*Assistant Examiner*—Stephen P. Avila
*Attorney, Agent, or Firm*—Wood, Herron & Evans

[57] ABSTRACT

A hydrocyclone separator has a central feed section, an upper vortex finder, and a lower conical section. A spigot and socket connection is provided to join the sections. Each spigot has a groove and each socket has a bead that mates with the groove. A band surrounds each connection and clamps them together to form a leak-tight connection.

8 Claims, 2 Drawing Sheets

SYSTEM FOR JOINING SECTIONS OF A HYDROCYCLONE SEPARATOR

BACKGROUND OF THE INVENTION

This invention relates to hydrocyclone separators and more specifically to a structure for joining sections of a hydrocyclone separator to form leak-tight connections.

Basically, a hydrocyclone separator is an accelerated settling device that can be used to separate solids from liquids or liquids from liquids. Hydrocyclone separators can be made from specially combined polyurethanes. They generally include a feed section connected to or integral with an overflow section at the top and a conical section connected to the bottom. These connections must remain leak-tight under high pressure (35–40 psi) at feed capacities of about eighty gallons per minute (for 3" diameter cone).

Sections of hydrocyclone separators are susceptible to wear caused by the nearly continuous passing of particles therethrough at these high pressures. The conical section of the hydrocyclone separators wears out faster than the feed section and therefore requires more maintenance in terms of replacement. The frequent replacement of the conical section makes it desirable to achieve quick and easy connections in order to minimize down time and reduce maintenance costs.

At the same time, quick and easy connections must remain leak-tight under high pressure in order to maximize the performance efficiency of the separation process. As a general rule, higher operating pressures can be maintained as the diameter of the cone decreases. As operating pressure is increased, smaller particles can be separated. Thus, smaller cones are generally used to separate smaller particles and this is done at high pressures. However, smaller size cones generally wear out faster and are not able to handle the volume of larger cones. An optimum in performance efficiency of the separation process would be achieved by providing a connection for a larger cone which is able to withstand the higher pressures which formerly required the use of a smaller cone.

Sections of prior art hydrocyclone separators hav been joined by the connection of mating threaded sections in a spigot and socket arrangement. Connection is generally achieved by screwing the spigot section into the socket section with a multiple number of turns. The snug fit between the surfaces of the spigot and the socket maintains a leak-tight connection.

However, this method of connection has not proved optimal. Due to the frequent accumulation of matter between the threads, the connected sections sometimes bond together during use. This bonding makes it extremely difficult to perform the multiple turns required to unscrew the sections to replace a worn part. Furthermore, connections of this type are not able to withstand the high pressure requirements of some applications. A typical conical section having a three inch diameter and the screw in connection mentioned above have been known to leak at a pressure of about 40 psi and blow apart at a pressure of about 50 psi. These limitations can be particularly troublesome in drilling applications where the density of the mud to be processed is subject to fluctuation, thus resulting in variations of pressure within this 40–50 psi range inside the hydrocyclone separator. Standard threads have also been known to deform at high temperatures, thereby reducing the quality of the connection and effectively precluding the use of mating surface connections for high temperature applications.

In the past, various types of heavy duty clamps about the outside surface of the socket section have been employed to withstand the high pressure applications of hydrocyclone separators. For instance, a V-retainer clamp has been placed directly on the seam of adjacent sections to apply both axial and radial compression to the adjacent V surfaces which have an interference fit of the upper and the lower sections. Although this practice has proved somewhat successful, V-retainer clamps alone are not able to provide the snug seal that is accomplished by threaded mating surfaces. Furthermore, these V-retainer clamps range in cost from $5.00 to $35.00, thereby increasing the cost of the connection.

It is therefore an object of this invention to provide a more economical structure for joining sections of a hydrocyclone separator using mating surfaces which are able to withstand high pressure and high temperature applications.

It is also an object of this invention to provide a connection for a hydrocyclone separator which allows increased performance efficiency in the separation of smaller particles.

It is further object of this invention to provide a structure for joining sections of a hydrocyclone separator which avoids problems associated with matter building up between threaded mating surfaces of a spigot and socket.

It is a still further object of this invention to provide a high pressure, leak-tight seal between sections of a hydrocyclone separator which allows quick and easy replacement of worn parts in order to reduce maintenance costs.

SUMMARY OF THE INVENTION

To achieve these ends, a system for joining an upper section and a lower section of a hydrocyclone separator comprises a first section being a generally cylindrical socket, a second section being a generally cylindrical spigot. One of the socket and spigot sections has a one-turn helical groove and the other has a mating one-turn helical bead. The helical bead and helical groove have at least a 1/16 inch radius. The sections are snugly inserted with the helical bead in communication with the helical groove. A metal clamp surrounds the inserted sections and is tightened to apply radial compression to form the leak-tight connection.

The sections can be brought together by applying an axial force between the two sections. The resilience of the urethane material permits the bead on one section to ride over the other section until it snaps into the groove. Preferably, when bringing the sections together in an axial direction, the angular relationship should be such that about 1 inch or so additional twist (about 30°) is required to tighten the helical bead into the helical groove. Thereafter, the application of the axial band provides a leak-tight connection.

The resistance to leakage can be improved by providing an O-ring seal between the two sections. The O-ring requires a shoulder on the socket section on which the O-ring rests and a circular surface on the spigot section which, upon final twisting of the sections, applies axial compression to the O-ring. A joint thus formed will withstand up to 75 psi of hydraulic pressure.

Alternatively, or additionally, the resistance to leakage can be improved by embedding a cylindrical steel band in the spigot section underlying the bead or groove. The steel band provides an incompressible structure against which the socket and spigot sections can be compressed by the outer steel clamp.

When there is a need to replace the cone, for example, the steel band is first removed. The helical bead and groove are then easily disengaged simply by rotating in one direction or the other. If the sections are rotating in the tightening direction, the helical bead quickly rides out of the groove in about 1 inch or so of rotation and the sections are then easily disassembled. Alternatively, by rotating in the opposite direction, the sections simply become loosened in a conventional manner.

In an alternative form of the invention, the helical bead and groove are replaced by a circular bead and groove. The sections are brought together by forcing the spigot section axially into the socket section until the bead pops into the groove. In removing the sections, it may be necessary to provide an external recess in the spigot portion into which a screwdriver can be placed with the screwdriver bearing against the edge of the socket section to force the sections apart in an axial direction.

The primary advantage of the invention is the improvement in the resistance to leakage while at the same time enhancing the ease with which the sections can be disassembled.

DETAILED DESCRIPTION OF THE DRAWINGS

Figure 1:
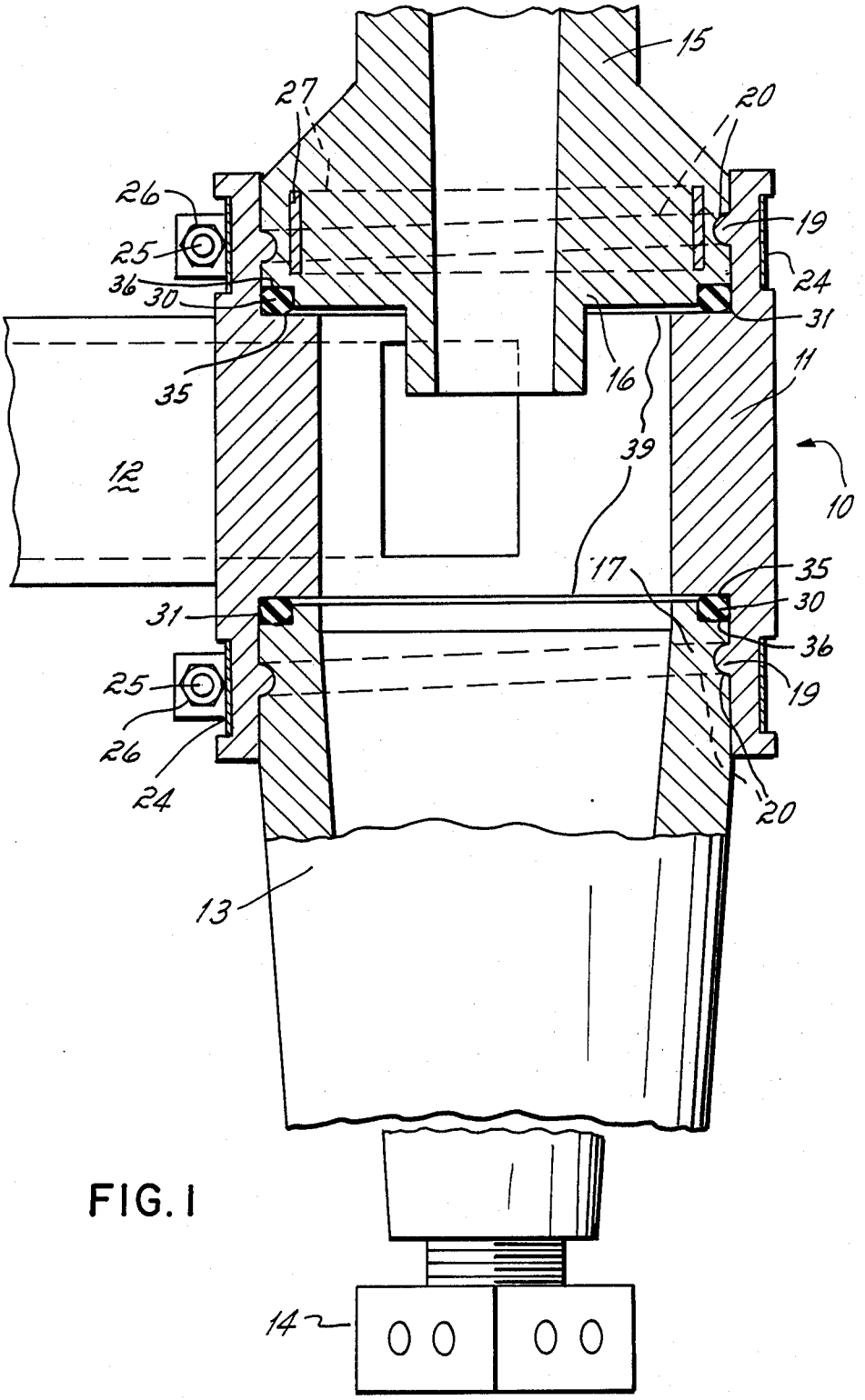
FIG. 1 is an enlarged cross-sectional view of a hydrocyclone separator illustrating the invention.

As shown in the drawings, a typical hydrocyclone separator 10 includes a feed section 11 which opens to a feed inlet 12, a conical section 13 connected to the bottom of the feed section 11 and which leads to a nozzle 14, and an overflow (or vortex finder) section 15 which is connected to the top of the feed section 11.

When a mud or a slurry is introduced into the feed section 11 through the feed inlet 12, it is separated into solid and liquid components. A hydrocyclone separator which has a feed section 11 with a three inch diameter effectively separates out particles in the 7–20 micron range at a feed capacity of 30–80 gallons per minute at a pressure of about 35–40 pounds per square inch. Under these conditions, it is essential that the connections between the feed section 11 and the other sections of the hydrocyclone separator remain leak- tight.

The overflow section 15 has a lower end portion 16 and the conical section 13 has an upper end portion 17 serving as spigots snugly inserted into sockets provided by the feed sections 11. It is to be understood that, alternatively, the lower end portion 16 of the overflow section 15 or the upper end portion 17 of the conical section 13 may provide a socket while the feed section serves as a spigot for either connection. Either the spigot or the socket has a helical bead 19 while the other has a mating helical groove 20 as shown in FIG. 1. Each of the helices extend substantially around one circumference between the connected spigot and socket. An O-ring 30 is seated between the spigot and socket section in a void 31 of the overflow section 15 and conical section 13, respectively. Each void is formed between a circular shoulder 35 on the feed section 11 and a circular stepped end surface 36 on the overflow section 15 and conical section 13, respectively.

Connection is accomplished by inserting the spigot into the socket so that the spigot can be rotated with respect to the socket to bring the helical bead 19 in communication with the helical groove 20. The spigot is then rotated no more than one full turn with respect to the socket thereby tightening the spigot within the socket to compress the O-ring 30 and to bring the entire length of the helical bead 19 in communication with the helical groove 20. Alternatively, the sections are simply forced together axially with a few degrees of angular misalignment. After the bead snaps into the groove, an additional twist of about an inch compresses the O-ring and completes the seating of the bead in the groove.

The use of the helical bead 19 and the helical groove 20 provides a communicating surface extending substantially around one circumference between the snugly inserted sections. The compression of the O-ring 30 provides additional sealing capabilities. At the same time, the helical bead 19 is thicker than a standard thread and therefore better able to withstand high pressure and high temperature applications. The radius of the helical bead 19 may vary with the diameter of the feed section 11. The diameter of the feed section 11 should be in the range of about 1–6 inches. The radius of the bead should be in the range of about 1/16 to ½ inch. In the illustrated form of the invention, the diameter of the feed section 11 is about three inches and the diameter of the bead is about 3/16 inch.

The one-turn connection of helical bead 19 and helical groove 20 avoids problems associated with matter building up between the multiple mating surfaces of multiple threads. Without this buildup of matter, replacement of worn parts becomes a relatively quick and easy procedure, thereby reducing maintenance costs.

A clamp 24 surrounds the inserted sections. This invention allows the use of a conventional T-bolt band clamp, thereby avoiding the costs associated with a V-retainer clamp and resulting in a more economical connections. The clamp 24 is provided with projecting lugs through which a threaded bolt 25 passes. A nut 26 permits the tightening of the clamp to apply radial compression to the socket to press it against the spigot and the bead against the groove. This combination of the clamp 24 compressing against the spigot, the communicating surfaces of the helical bead 19 and the helical groove 20 and the compressed O-ring 30 seated between connected spigot and socket sections provides a leak-tight seal which is able to withstand up to about 75 psi of pressure.

In practice, this combination allows a cone having a 3 inch diameter to perform the separations that formerly required a cone having a 2 inch diameter. Because a 3 inch cone is generally better able to withstand the wear to extensive use and also able to handle a greater volume than a 2 inch cone, this invention results in an increase in the efficiency of the separation process.

As an alternative to the O-ring 30, or a supplement to it, a steel ring 27 may be molded into the spigot to further increase sealing capabilities and to provide stable support against the radial compression applied by the clamp 24.

This combination also allows quick and easy replacement of worn parts, thus reducing maintenance costs.

To disassemble, the clamp 24 is loosened and the conical section is removed from the feed section. This removal can be accomplished by simply pulling the conical section out from the feed section or by rotating the conical section out of the feed section. Removal by rotation may be accomplished by one of two simple methods. First, a conventional unscrewing of the conical section will withdraw the helical bead 19 from the helical thread 20 and cause the conical section to back out of the feed section. Second, further rotation of the conical section 13 in the tightening direction will cause the one-turn helical bead 19 to "jump out" of the one-turn helical groove 20 and a gap 39 closes between the circular shoulder 35 of the feed section 11 and part of the circular stepped-end surface 36 of the conical section 13. After about an inch or so of rotation, the gap 39 has closed and the shoulder 35 and surface 36 abut and resist the further insertion of th spigot caused by rotation. At this point, further rotation results in the conical section "popping" out of the feed section.

Figure 2:
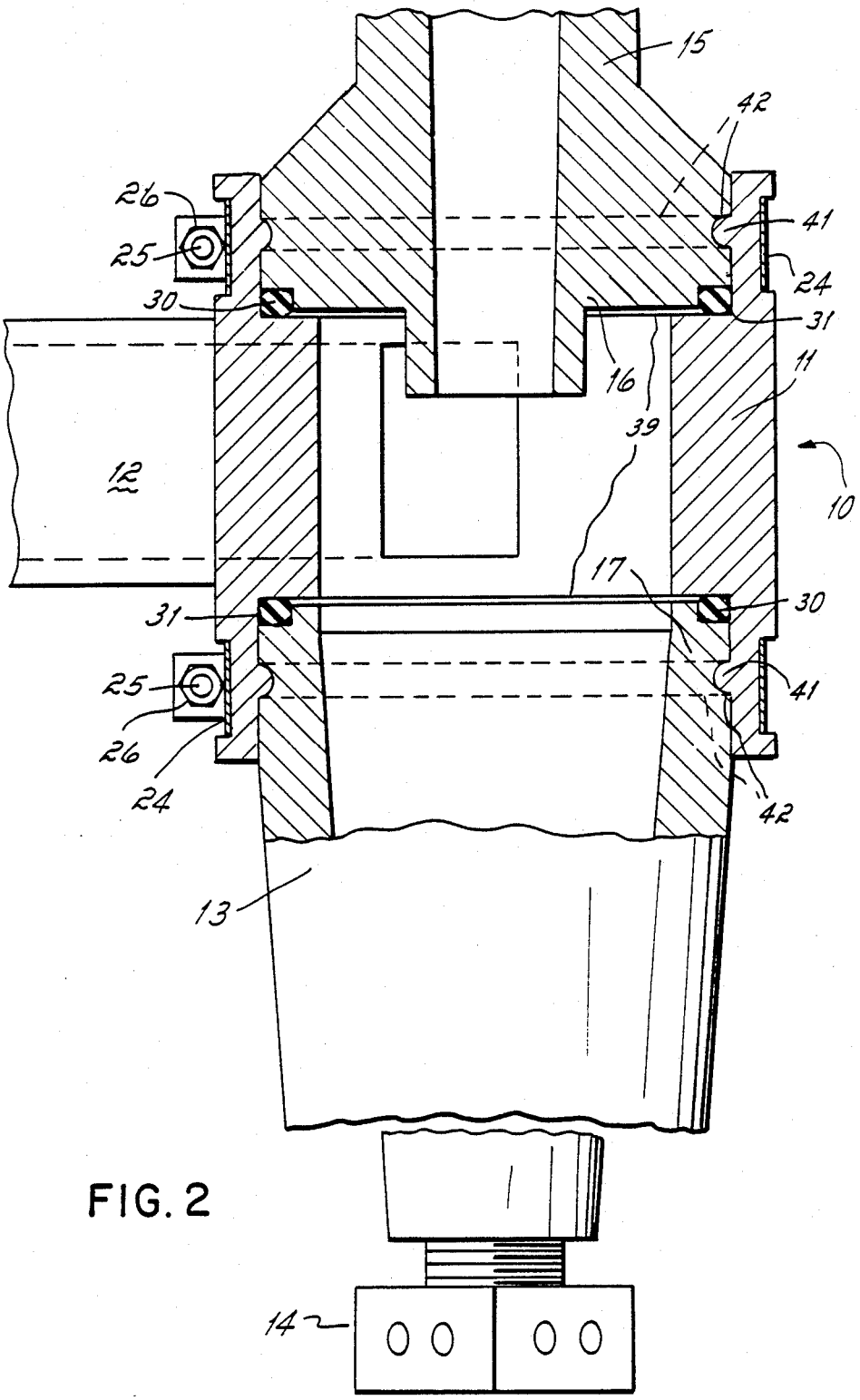
FIG. 2 is a cross sectional view of a hydrocyclone separator, similar to FIG. 1, illustrating an alternative embodiment of the invention.

FIG. 2 shows an alternative embodiment of this invention. One of the spigot and socket sections has a circular bead 41 and the other has a mating circular groove 42. Connection is accomplished by snugly inserting the spigot within the socket so that the circular bead 19 and circular groove 20 are in communication. The clamp 24 is then tightened to apply radial compression to the socket to compress it against the spigot. To disassemble, the clamp 24 is loosened and the conical section is forcibly withdrawn from the feed section. Alternatively, an O-ring 30 may be located between the circular shoulder 35 of the socket and the circular stepped-end surface 36 of the spigot to improve the seal.

Other modifications and embodiments will be readily apparent from the foregoing and from the drawings without departing from the scope of the invention if applicant intends to be bound only by the claims appended hereto.

What is claimed is:

1. In the hydrocyclone separator having an upper section and a lower section, a structure for joining said upper section to said lower section comprising, a first section providing a generally cylindrical socket, a second section having a generally cylindrical spigot inserted snugly into said socket, one of said socket and spigot having a one turn helical groove and the other having a mating helical bead forming a connection between said spigot and said socket, and a metal clamp surrounding said inserted sections, said clamp being tightened to apply radial compression to said socket to press it against said spigot and, to press said bead against said groove to form a leak-tight connection.

2. A hydrocyclone separator as in claim 1 further comprising, a compressible O-ring residing between said spigot and socket sections.

3. A hydrocyclone separator as in claim 1 wherein said socket has a one to six inch diameter and said helical bead and said mating helical groove have approximately a 1/16 to ½ inch radius.

4. A hydrocyclone separator as in claim 1 further comprising a steel insert ring molded into said spigot underlying said helical bead or groove, thereby to provide additional stability against radial compression applied by said clamp.

5. In a hydrocyclone separator having an upper overflow section, a central feed section connected to said overflow upper section, and a lower conical section connected to said feed section, a structure for joining connected sections comprising:

said feed section providing upper and lower cylindrical sockets;

a compressible O-ring residing within said upper and lower cylindrical sockets, said overflow and conical sections providing cylindrical spigots inserted snugly into respective sockets, said spigot having an approximately one-turn helical groove and each said socket having a mating approximately one-turn helical bead forming a connection between socket and spigot;

said helical groove and said mating helical bead requiring about one full turn to compress said O-ring and form said connection between spigot and socket; and a metal clamp surrounding said inserted sections, said clamp being tightened to apply radial compression to said socket to press it against said spigot to form a leak-tight connection.

6. In a hydrocyclone separator having an upper section and a lower section, a structure for joining said upper section to said lower section comprising, a first section providing a generally cylindrical socket, a second section having a generally cylindrical spigot inserted snugly into said socket, one of said socket and spigot having a circular groove and the other having a mating circular bead forming a connection between said spigot and socket, and a metal clamp surrounding said inserted sections, said clamp being tightened to apply radial compression to said socket to press it against said spigot and, to press said bead against said groove to form a leak-tight connection.

7. A hydrocyclone separator as in claim 6 further comprising, an O-ring located between said spigot and socket sections.

8. In a hydrocyclone separator having an upper section and a lower section, a structure for joining said upper section to said lower section comprising, a first section providing a generally cylindrical socket, a second section having a generally cylindrical spigot inserted snugly into said socket, one of said socket and spigot having a groove and the other having a mating bead forming a connection between said spigot and socket, said groove and bead extending substantially around one circumference between the spigot and socket, and a metal clamp surrounding said inserted sections, said clamp being tightened to apply radial compression to said socket to press it against said spigot and, to press said bead against said groove to form a leak-tight connection.

* * * * *